US006328577B1

(12) United States Patent
Azuma

(10) Patent No.: US 6,328,577 B1
(45) Date of Patent: Dec. 11, 2001

(54) HIGH DENSITY ELECTRIC CONNECTOR SET

(75) Inventor: Eddie A. Azuma, Yokohama (JP)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/532,548

(22) Filed: Mar. 22, 2000

(30) Foreign Application Priority Data

Mar. 25, 1999 (JP) ..... 11-081474

(51) Int. Cl.[7] ..... H01R 12/00; H05K 1/00

(52) U.S. Cl. ..... 439/83; 439/74; 439/931; 29/843; 29/884

(58) Field of Search ..... 439/83, 876, 74, 439/931; 29/842, 843, 844, 882, 884, 878, 876, 874

(56) References Cited

U.S. PATENT DOCUMENTS

| | | | |
|---|---|---|---|
| 5,593,322 | 1/1997 | Swamy et al. | 439/660 |
| 5,730,606 | 3/1998 | Sinclair | 439/70 |
| 5,746,608 | 5/1998 | Taylor | 439/70 |
| 5,772,451 | 6/1998 | Dozier, II et al. | 439/70 |
| 6,164,983 * | 12/2000 | Lemke et al. | 439/83 |

FOREIGN PATENT DOCUMENTS 2 325 354 A 11/1898 (GB) .

* cited by examiner

*Primary Examiner*—Neil Abrams
*Assistant Examiner*—Javaid Nasri
(74) *Attorney, Agent, or Firm*—Perman & Green, LLP

(57) ABSTRACT

An electric connector is provided which can be highly accurately positioned to a location to be aligned. An electric connector set comprises a pair of insulating housings 10, 10*a* so formed as to have a plurality of openings 14 arranged in an array and a plurality of projections 18 each extending into the associated opening, female terminals 24 made of metal and each detachably fitted over the corresponding projection 18 of one of these housings, having a solder ball 30 and soldered to an IC package p through each solder ball, male terminals 34 each having a contact section 38 provided around the projection 18 of the other housing 10*a* and engageable with the corresponding female terminal 24 and a lead section 36 electrically connecting its housing bottom side 22 to the contact section 38, and solder balls 40 attached to the lead section 36 at the bottom surface on the housing.

14 Claims, 6 Drawing Sheets

HIGH DENSITY ELECTRIC CONNECTOR SET

BACKGROUND OF THE INVENTION

The present invention relates to a high density electric connector, called as a BGA connector, connected to a board through solder balls arranged in a grid array.

With a recent tendency of an electronic apparatus, such as a computer, toward a high density and miniaturization, a surface-mounting type high density connector called as a BGA connector has been developed in which a connection to a board is formed with solder balls such that the solder balls are arranged as a grid array on a housing. The BGA connector is positioned on contact pads arranged on a board surface. Then a resultant unit is heated to allow at least a portion of each terminal which is formed with the solder ball to be partially melted. By doing so, the solder ball is fused to the associated contact pad on the board. A distance between the adjoining solder ball terminals is very close and it is possible to provide a large number of connection portions on the board at a restricted area.

In the case of a very compact, high-density connector for an IC package such as a CPU, it is very difficult to align each terminal relative to a large number of small electrodes arranged in a grid array. Thus a cumbersome operation is involved. Further, it is also difficult to align each terminal with respective terminals of a separately formed mating connector.

BRIEF SUMMARY OF THE INVENTION

It is accordingly the object of the present invention to provide very simple, inexpensive electrical connectors which can highly accurately align respective terminals of a pair of male and female connectors.

In one aspect of the present invention, there is provided an electric connector set comprising: a pair of insulating housings having a plurality of openings arranged in an equal array and opened at a top surface, a plurality of projections extending from a bottom wall into the openings, and a plurality of slots extending through the bottom wall at those positions adjacent to the respective projections and allowing the bottom surface to communicate with the respective opening; female metal terminals detachably attached to the respective projections and each having a pair of arm sections and a base section connecting these arm sections to each other with a solder ball attached thereto, these female terminals being soldered by solder ball to one of an IC package and printed circuit board; male terminals having a contact section including a plated conductive layer formed on a peripheral portion of such projection of the other housing and engageable with the female terminal and a lead section including a plated conductive layer formed at those portions of the projection corresponding to the slot and housing bottom surface and electrically connected to the contact section; and the solder balls connected to the plated conductive layers of the housing bottom surface and soldered to the other of the IC package and printed circuit board.

According to the electric connector set, the female terminals are soldered to one of the IC package and printed circuit board in a manner to be attached to the projections of one of the paired housing. When the housing is detached, the female terminals are exposed in a state to be protected from said one of the IC package and printed circuit board. Since, on the other hand, the male terminals are projected in the associated openings equal in array to the openings of the housing with the female terminals attached thereto, the male terminals and female terminals are positively located in their mutually aligned positions.

In another aspect of the present invention, there is provided a male connector comprising: an insulating housing having a plurality of openings arranged in an equal array to an array of terminals of an associated female connector and opened at a top surface, a plurality of projections extending from a bottom wall into the corresponding opening, and a plurality of slots extending through the bottom wall at those positions adjacent to the projection and allowing the bottom surface to communicate with the opening; male terminals including a contact section having a plated conductive layer formed on a peripheral portion of the projection of the housing and engageable with the female terminal and a lead section including a plated conductive section formed at those portions of the projection corresponding to the slot and housing bottom surface and electrically connected to the contact section; and solder balls connected to the plated conductive layer on the housing bottom surface and soldered to the other of an IC package and printed circuit board. It is preferable that the contact section of the male terminal further have a plated contact layer on the conductive layer directly plated to the housing, the conductive layer containing gold.

In another aspect of the present invention, there is provided a female connector forming set comprising: an insulating housing having a plurality of openings arranged in an equal array to terminals of a male connector and a plurality of projections extending form a bottom wall into the openings; female metal terminals detachably mounted on the projections and each having a pair of arm sections and a base section connecting these arm sections to each others; and solder balls attached to the base section of the respective female terminal and projected from a top surface of the housing, wherein, through these solder balls, respective female terminals are solderable to one of an IC package and printed circuit board.

Since the female connector forming set has its female terminals detachably attached to the projections of the housing, it is soldered by the solder balls to the IC package or printed circuit board. When, thereafter, the housing is detached, the female connector is formed integral with the IC package or the printed circuit board.

A method for manufacturing an electric connector, comprising the steps of: forming, at a pair of insulating housings, a plurality of openings arranged in an equal array and opened at a top surface, a plurality of projections extending from a bottom wall into the openings and a plurality of slots extending through a bottom wall at those positions adjacent to the respective projections and allowing the bottom surface to communicate with the respective opening; detachably attaching, to the respective projections of one of these housings, female metal terminals each having a pair of arm sections and a base section connecting together these arm sections with a solder ball attached on the base section; forming a continuous plated conductive layer on a peripheral portion of each projection of the other housing and on these portions of the projection corresponding to the slot and housing bottom surface and, by doing so, forming male terminals; connecting the solder ball to a plated conductive layer of the male terminal which is formed at the housing bottom surface; soldering the paired housings by the solder balls to an IC package and printed circuit, respectively, using a reflow soldering method; and detaching the one housing with the respective female terminals attached thereto from one of the IC package and printed circuit board and, by doing so, connecting together the IC package and printed circuit board.

DETAILED DESCRIPTION OF THE INVENTION

Figure 1:
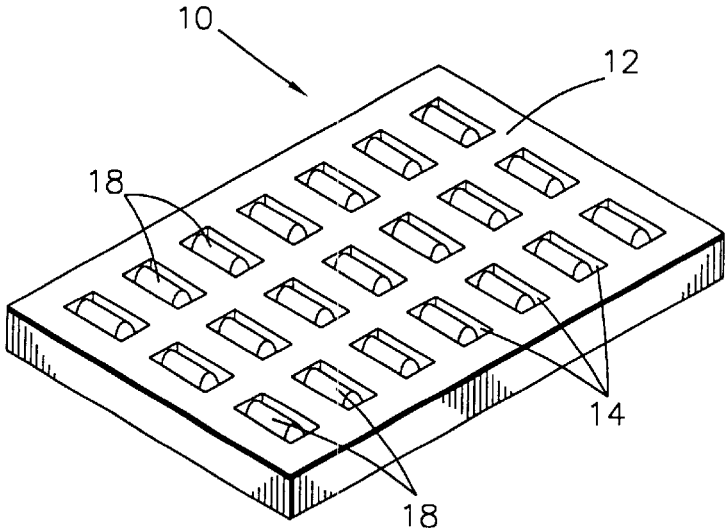
FIG. 1 is a perspective view diagrammatically showing an insulating housing for forming an electric connector set according to a preferred embodiment of the present invention.
Figure 2:
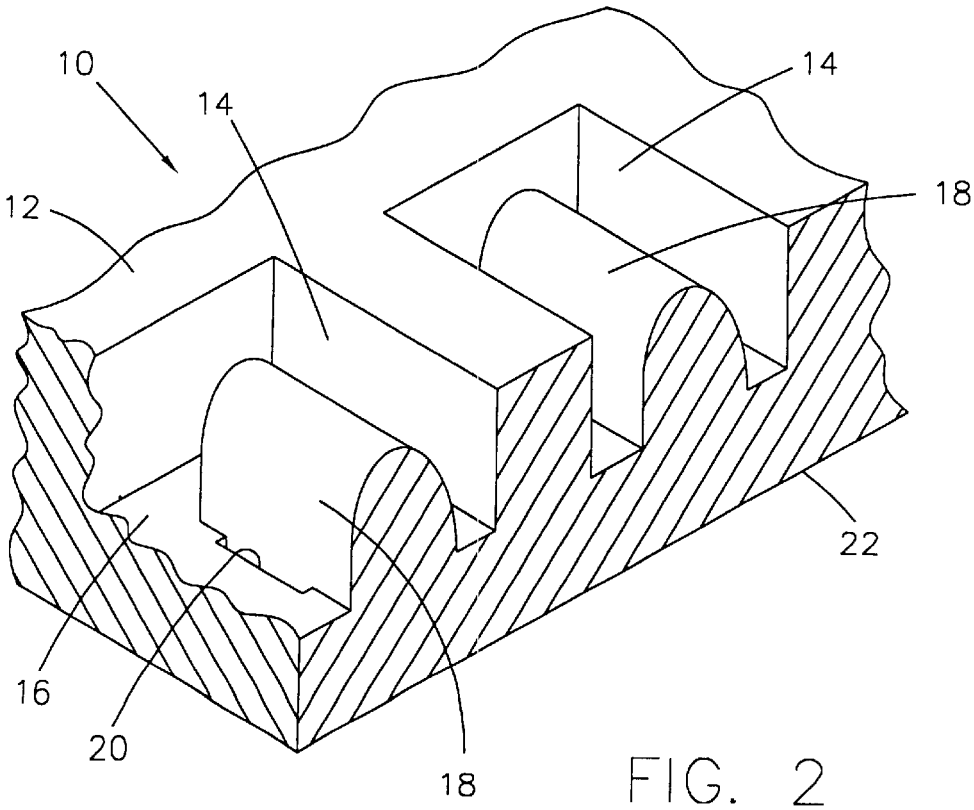
FIG. 2 is an explanatory view, partly enlarged, showing part of the insulating housing in FIG. 1.

FIG. 1 schematically shows a whole of an insulating housing 10 according to an embodiment of the present invention and FIG. 2 shows a partially enlarged view.

The insulating housing 10 is formed of a suitable insulating material such as a liquid crystal polymer and a large number of openings 14 are opened in a predetermined pattern array in a top surface of the insulative housing. Projections 18, each, extend from a bottom wall 16 into the opening 14. A tapered end of the projection 18 is situated substantially flush with the top surface 12 of the insulating housing 10. Slots 20 are formed in positions adjacent both sides of the respective projection 18 and extend through the bottom wall 16. Through the slots 20 the opening 14 communicates with a bottom surface 22 of the insulative housing 10.

Figure 3:
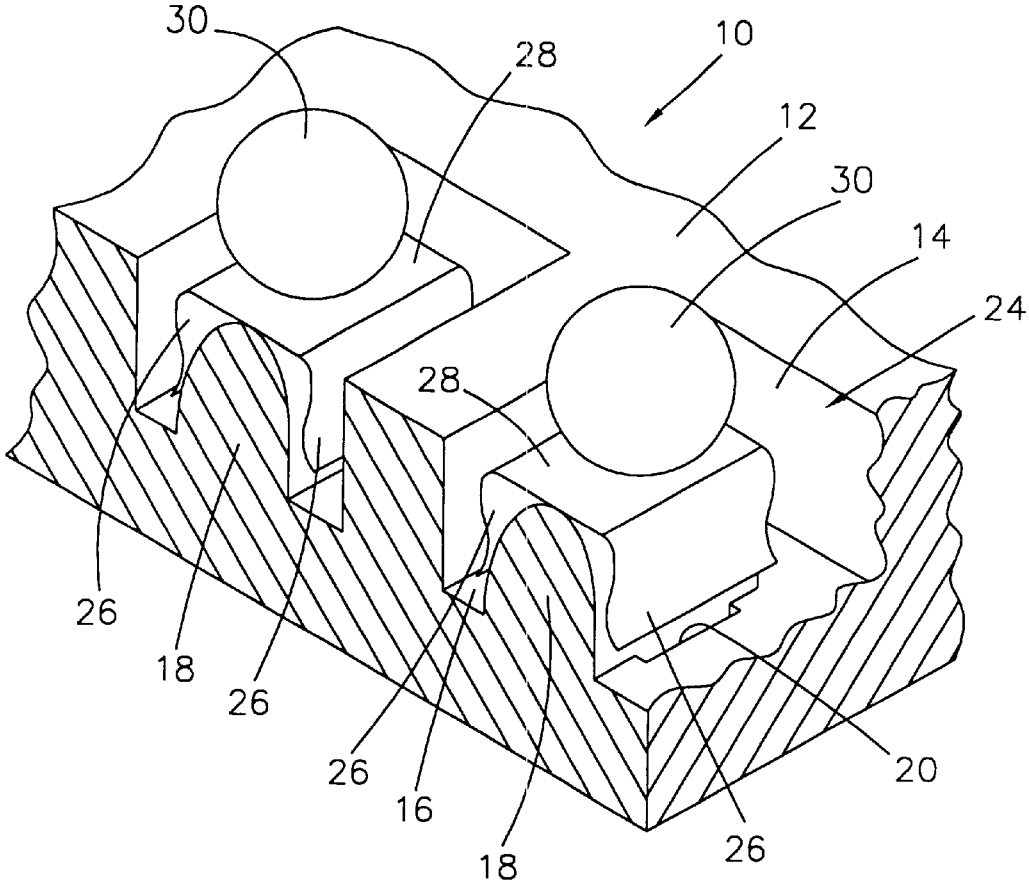
FIG. 3 is an explanatory view diagrammatically showing the insulating housing of FIG. 1 with female terminals and solder balls attached thereto.

In the case where a female connector is to be formed, as shown in FIG. 3, preformed female terminals 24 each are detachably mounted on the projection 18 in the respective opening 14. The female terminal 24 in the present embodiment is formed like a clip and has a pair of plate-like spring arm sections 26 and a flat-plate-like base section 28 connecting these arm sections 26. The paired arms 26 pinch the projection 18 in a state contacting with the projection 18. Further, the base section 28 is situated substantially parallel with the top surface 12 of the housing 10 and a solder ball 30 is attached on the base section 28 by a reflow soldering technique for example.

The respective female terminal 24 is formed of a suitable terminal material such as phosphor bronze or beryllium copper. A tin-lead plated layer is formed at the female terminal's area on which the solder ball 30 is attached. It is preferable that a nickel underlaying gold-plated layer be formed at that portion of the female terminal with which the projection 18 is contacted. In the present embodiment, the female terminal 24 is comprised of a very simple structure having one pair of arms 26 and base section 28 and can be simply formed by one stamping operation.

The insulative housing 10 having each female terminal 24 attached on the projection-18 with the solder ball 30 provides a female connector for providing a female connector on an IC package such as a CPU or a printed circuit board. In the case where an electric connector of the CPU for example is to be formed, each female terminal 24 is soldered to the IC package, by a reflow soldering method for instance, with the terminals 24 being arranged on the insulating housing 10. In this case, in accordance with the array of the female terminals, the openings 14 of the insulating housing 14 have their spacing, their size, etc., formed to match an array of electrodes exposed on the surface of the IC package. The respective female terminals have their solder balls 30 soldered to the associated electrodes of the IC package by the reflow soldering for instance and a resultant structure is formed as an IC package with the female connector integral therewith.

Figure 4:
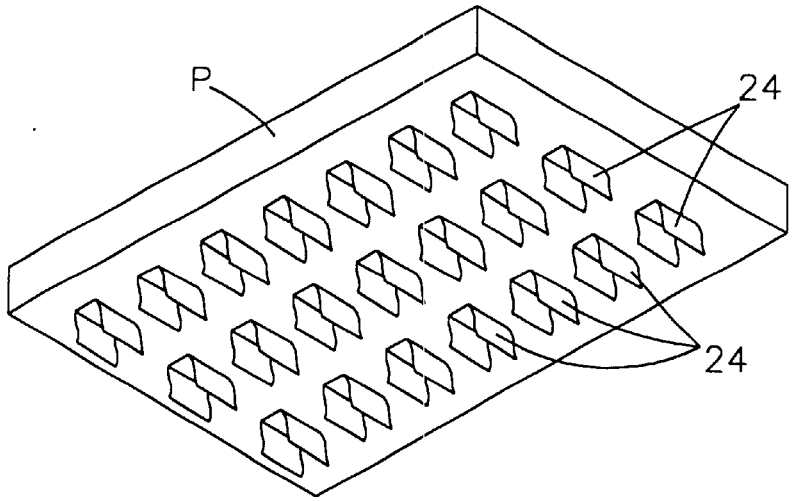
FIG. 4 is a perspective view diagrammatically showing an IC package with the female terminals attached thereto.

FIG. 4 shows a state in which the female terminals 24 are mounted on an IC package P. In FIG. 4, the female terminals 24 are shown detached from the insulating housing 10. It is evident that, in order to protect the female terminals and IC package P, the insulating housing 10 is preferably retained in an mounted state until immediately before the female terminals are connected to an associated male connector.

Figure 5A:
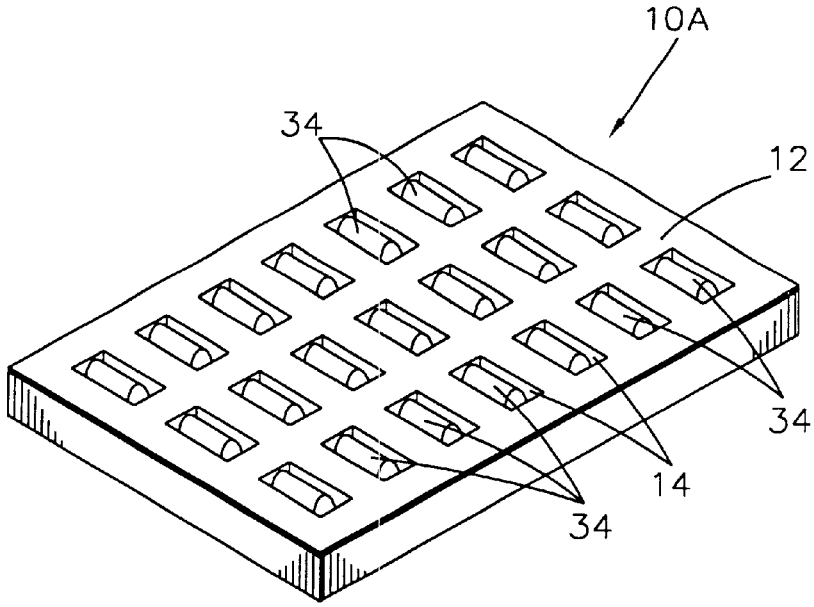
FIG. 5 shows a male connector according to a preferred embodiment of the present invention, (A) in FIG. 5 generally showing a perspective view and (B) in FIG. 5 being a cross-sectional view, partly enlarged, showing the male terminal.
Figure 5B:
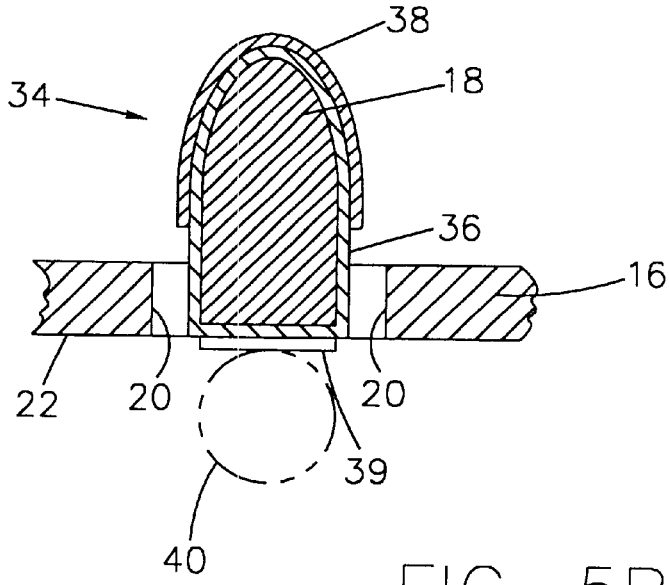
Figure 6:
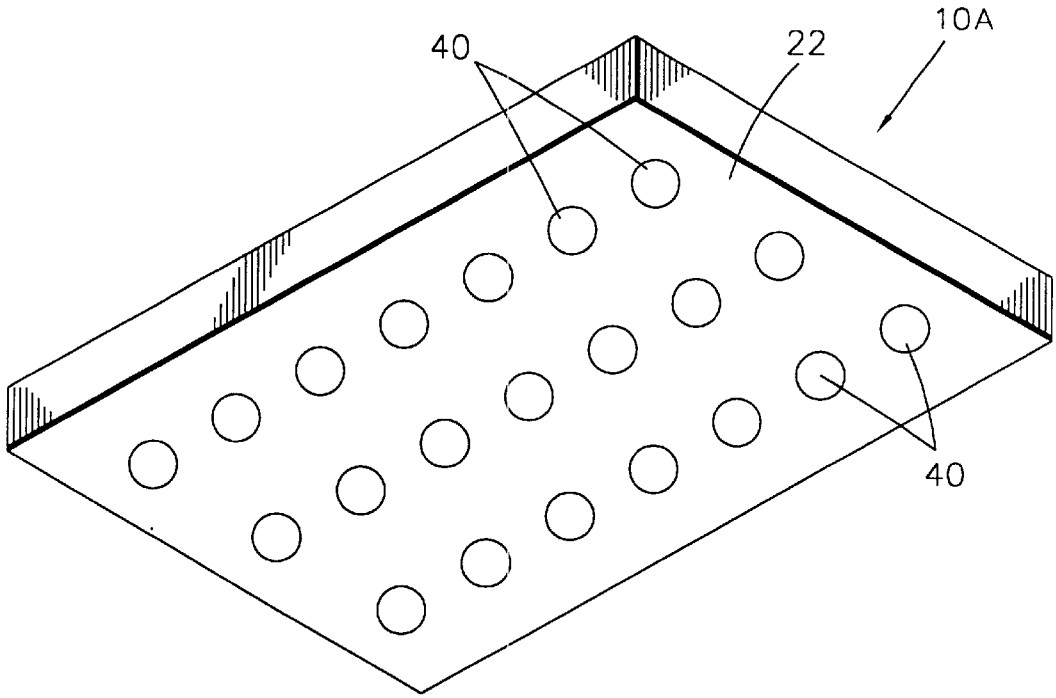
FIG. 6 is a perspective view diagrammatically showing a state of the male connector as viewed from a solder ball side.

FIGS. 5 and 6 show another insulative housing 10*a* formed such that it has the same structure as that of the above-mentioned housing 10. In this housing, the same reference numerals are employed to designate parts or elements corresponding to those shown in the housing 10 and any further explanation is emitted for brevity.

The insulating housing 10*a* constitutes a male connector. Respective projections 18 are formed as male terminals. For this reason, as shown in (B) in FIG. 5, a conductive layer 36 is directly plated to a plastic base, such as a liquid crystal polymer, and formed on an outer periphery of each projection 18, on an inner peripheral portion of the slot 20 adjacent the projection 18 and on a portion of the projection 18 corresponding to a bottom surface 22 of the housing, so that the conductive layer is electrically connected to the bottom surface 22 side. Further, a nickel underlaying gold-plated layer is formed on the projection 18 side contacting with the above-mentioned female terminal 24. A tin-lead plated layer 39 is formed at a portion of the bottom surface 22 on a side opposite to that of the projection 18. A solder ball 40 constituting a contact section is attached on the tin-lead plated layer 39 by the reflow soldering technique for instance. By doing so, the solder ball 40 is electrically connected by the tin-lead plated layer 39 to the inside plated conductive layer 36 and by the conductive layer 36 to the plated contact layer 38 on the projection 18 side, the conductive layer 36 constituting a lead section. FIG. 6 shows a grid array of solder balls 40 attached on the bottom surface 22 side of the housing 10*a*.

The thus formed insulating housing 10*a* constitutes a male connector where each male terminal 34 is arranged in an associated opening 14 and the solder balls 40 are projected from the bottom surface of the housing 10*a*. The male connector can be soldered by its solder balls 40 to the conductive pads of the printed circuit board, etc., with the use of, for example, the reflow soldering technique.

Figures 7A, 7B:
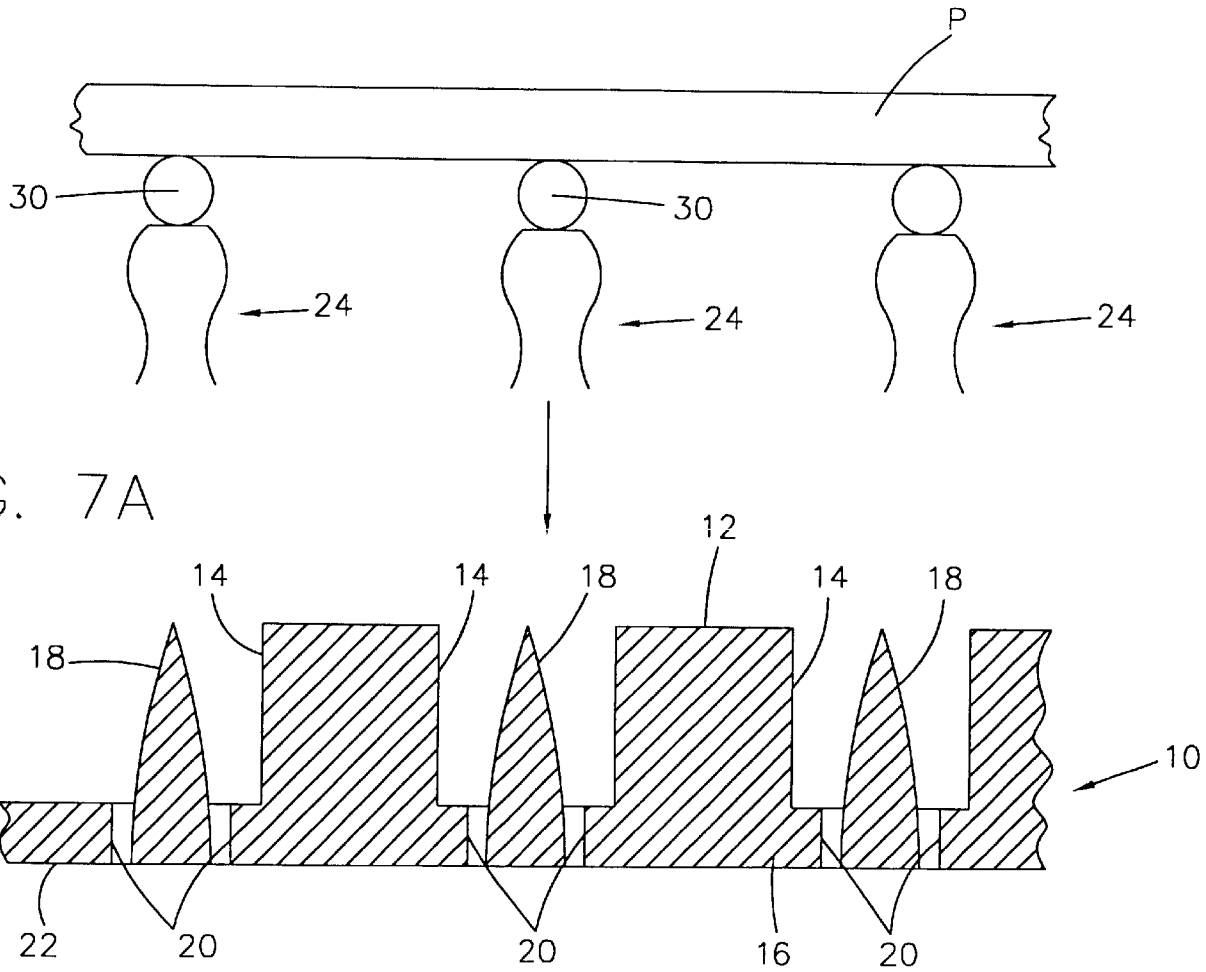
FIG. 7 shows an IC package with the female terminals attached thereto, (A) in FIG. 7 being a side view diagrammatically showing an IC package immediately before being connected to the male connector after the insulating housing has been detached and (B) in FIG. 7 being a cross-sectional view showing the detached insulating housing.
Figure 8:
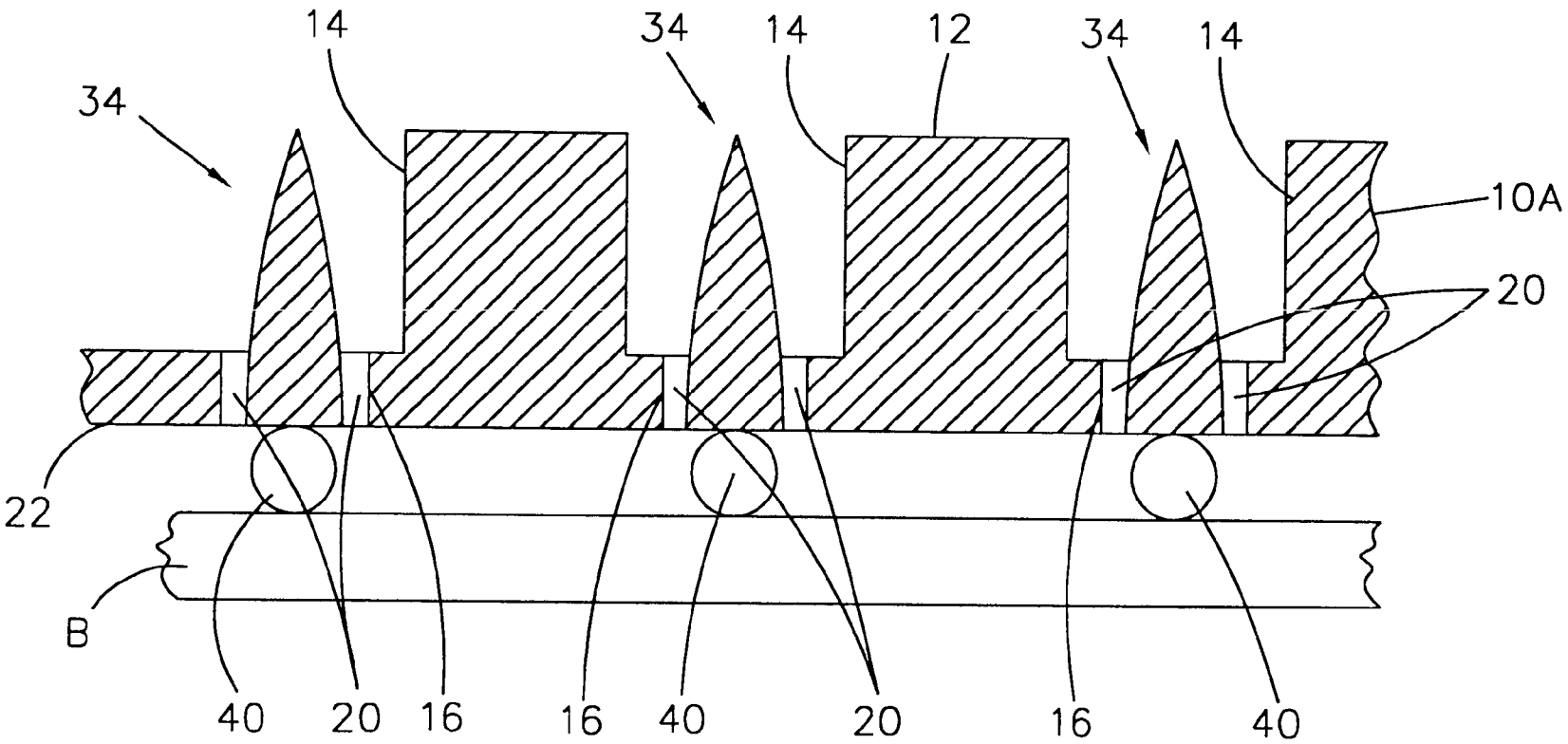
FIG. 8 is a cross-sectional view showing a male connector attached to a printed circuit board.

FIGS. 7 and 8 show the IC package P with female terminals 24 mounted thereon and a printed circuit board B having the male connector with the insulating housing 10*a*. This IC package P is shipped such that, at a manufacture of the IC Package P, female terminals 24 and insulating housing 10 are mounted thereon. When the IC package P is mounted on the printed circuit board B, the insulating housing 10 is removed from the IC package P. FIG. 7(A) shows the IC package P with the insulating housing 10 detached, and FIG. 7(B) shows the insulating housing 10 detached from the IC package P. Since the insulating housing 10 is the same in structure as the insulating house 10*a* for forming the male connector on the printed circuit board B; the respective female terminals 24 attached on the projection 18 are aligned with the associated male terminals 34 formed on the projections 18, so that the male terminals 24 and female terminals 34 can be set in a positively engaged state without being misaligned from each other. Further, the respective female terminals 24 are transported in such a state as to be protected with the insulating housing 10. As a result, these female terminals 24 and IC package are not damaged during transportation.

Further, the insulative housing 10 and insulative housing 10*a* are the same in structure and it is not necessary to manufacture two types of housings in a separate fashion. It is, therefore, possible to manufacture both electric connectors, male and female, with the use of a single mold.

As evident from the above, according to the present invention, an electric connector set comprised of the male and female connectors can be manufactured at low costs by the use of a pair of insulating housings having the same size and structure. Through the male connector and female connector, it is possible to readily and positively connect together an IC package and printed circuit board having a large number of electrodes in a high density array.

The male connector is such that the respective male terminal has a plated conductive layer formed on the circumference of the projection. Therefore, it is not necessary to attach any separate metal terminals, so that the male connector can be manufactured at low costs.

Since the female connector is such that the female terminals are attached by the solder balls to the IC package or printed circuit board, it can be formed as a very compact unit. And the female terminals are attached to, and held in place in, the insulating housing the same as the insulating housing for the male terminals, so that it is possible to positively prevent any misalignment of the male terminals with the female terminals.

What is claimed is:

1. An electric connector set comprising:

a pair of insulating housings, each housing having a plurality of openings arranged in an equal array and opened at a top surface, a plurality of projections extending from a bottom wall into the openings, and a plurality of slots extending through the bottom wall at positions adjacent to respective projections and allowing a bottom surface of each housing to communicate with the respective opening;

female metal terminals detachably attached to respective projections of one of the insulating housings, and each of the female terminals having a pair of arm sections and a base section connecting the arm sections to each other with a solder ball attached thereto, the female terminals being soldered by solder balls to one of an IC package and printed circuit board;

male terminals, each having a contact section including a plated conductive layer formed on a peripheral portion of one of the projections of another of the housings and engageable with one of the female terminals, and a lead section including a plated conductive layer formed at portions of the projection corresponding to the slots and housing bottom surface and electrically connected to the contact section; and solder balls connected to the plated conductive layers of the housing bottom surface of the other housing and soldered to another one of an IC package and printed circuit board.

2. A male connector comprising:

an insulating housing having a plurality of openings arranged in an equal array to terminals of an associated female connector and opened at a top surface, a plurality of projections extending from a bottom wall into corresponding openings, and a plurality of slots extending through the bottom wall at positions adjacent to the projections and allowing a bottom surface to communicate with the opening;

male terminals, each including a contact section having a plated conductive layer formed on a peripheral portion of one of the projections of the housing and engageable with one of the terminals of the female connector and a lead section including a plated conductive section formed at portions of the projection corresponding to the slots and housing bottom surface and electrically connected to the contact section; and solder balls connected to the plated conductive layer on the housing bottom surface and soldered to one of an IC package and printed circuit board.

3. The male connector according to claim 2, wherein the contact section of the male terminal further has a plated contact layer on the conductive layer plated to the housing, the contact layer containing gold.

4. A female connector assembly comprising:

an insulating housing having a plurality of openings arranged in an equal array to terminals of a male connector and a plurality of projections extending from a bottom wall into the openings;

female metal terminals detachably mounted on the projections and each having a pair of arm sections and a base section connecting these arm sections to each other; and solder balls attached to the base section of the respective female terminal and projected from a top surface of the housing, wherein, through these solder balls, respective female terminals are solderable to one of an IC package and printed circuit board.

5. An assembly for connecting first electrical terminals to an electronics component, the assembly comprising:

a first housing comprising openings into a first side of the housing and first projections extending into the openings;

a plurality of the terminals removably attached to the projections; and fusible elements attached to the terminals proximate the first side of the housing, wherein the fusible elements can be melted to attach the terminals to the electronic component, and wherein after the terminals are attached to the electronic component the housing can be removed from the terminals with the terminals passing through the openings in the first side of the housing.

6. The assembly as in claim 5 wherein the housing further comprises slots into the housing from a second side of the housing, the slots extending into the openings and the second side being opposite from the first side.

7. The assembly as in claim 5 wherein the terminals each comprise opposing arms removably attached to opposite sides of respective ones of the first projections.

8. The assembly as in claim 7 wherein the terminals each comprise a base connecting the arms to each other.

9. The assembly as in claim 8 wherein the fusible elements are attached to respective ones of the bases.

10. The assembly as in claim 9 wherein the bases are substantially flat and parallel to the first side of the housing.

11. The electrical connector set comprising:

the assembly as in claim 5; and a male connector comprising a second housing, second electrical terminals fixedly attached to the second housing, and second fusible elements attached to the second terminals, wherein the first and second terminals are adapted to mate with each other when the first housing is removed from the first terminals, and wherein the first and second housings are substantially the same size and shape.

12. The electrical connector set as in claim 11 wherein the second terminals comprise a conductive layer directly plated to second projections of the second housing, and wherein the second projections are substantially the same size and shape as the first projections.

13. The electrical connector set as in claim 12 wherein the second terminals comprise at least one plated contact layer on the conductive layer, and wherein the second fusible elements are electrically connected to the conductive layer and plated contact layer(s).

14. An electrical connector comprising:

an insulating housing comprising openings into a first side of the housing, slots extending into the openings from a second opposite side of the housing, and projections extending into the openings;

male terminals comprising a conductive layer directly plated to the projections, the layer extending through the slots and being located at the second side of the housing; and fusible elements connected to the conductive layer at the second side, wherein the projections provide structured support for the conductive layers to form the male terminals.

* * * * *